US006098339A

United States Patent [19]

Rivera et al.

[11] Patent Number: 6,098,339

[45] Date of Patent: Aug. 8, 2000

[54] REINFORCED JALOUSIE WINDOW WITH SPACED WALL SIDE JAMBS FOR PIVOT SUPPORT

[76] Inventors: Adriano Rivera, 507 Calle Sta. Teresa, Arecibo, Puerto Rico 00612; Francisco Martinez, Reno H-23, Vista Bella, Bayamon, Puerto Rico 00956

[21] Appl. No.: 08/797,263

[22] Filed: Feb. 7, 1997

[51] Int. Cl.[7] ..... E06B 7/08; E06B 7/086; E06B 7/10

[52] U.S. Cl. ..... 49/74.1; 49/73.1; 49/82.1

[58] Field of Search ..... 49/403, 73.1, 74.1, 49/82.1, 86.1, 64

[56] References Cited

U.S. PATENT DOCUMENTS

| | | | |
|---|---|---|---|
| 2,228,439 | 1/1941 | Cerny . | |
| 2,778,461 | 1/1957 | Girschowitch | 52/690 |
| 2,845,153 | 7/1958 | West | 49/371 |
| 3,116,057 | 12/1963 | Fink . | |
| 3,125,944 | 3/1964 | Radcliff | 49/51 |
| 3,159,909 | 12/1964 | Pappas . | |
| 3,205,541 | 9/1965 | Beards . | |
| 3,350,814 | 11/1967 | Dufrene . | |
| 3,375,608 | 4/1968 | Thompson | 49/403 |
| 3,484,990 | 12/1969 | Kahn et al. . | |
| 3,702,040 | 11/1972 | Roy | 49/64 |
| 4,038,781 | 8/1977 | Graham . | |
| 4,254,581 | 3/1981 | Ishihara | 49/82.1 |
| 4,256,143 | 3/1981 | Magill et al. . | |
| 4,294,283 | 10/1981 | Scharres | 137/601 |
| 4,813,183 | 3/1989 | Jordal . | |
| 4,889,040 | 12/1989 | Man . | |
| 4,934,438 | 6/1990 | Yuhas et al. | 160/107 |
| 4,996,793 | 3/1991 | Mazur | 49/74.1 |
| 5,001,864 | 3/1991 | Truscott | 49/403 |
| 5,267,414 | 12/1993 | Vaida . | |
| 5,490,353 | 2/1996 | McLaughlin | 49/64 |
| 5,560,147 | 10/1996 | Ashida et al. | 49/74.1 |
| 5,794,380 | 8/1998 | Guardia | 49/74.1 |

OTHER PUBLICATIONS

Window drawings by Industrias Metallicas Marva, purportedly manufactured under U.S. Patent No. 5,267,414 to Vaida (listed above).

*Primary Examiner*—Daniel P. Stodola
*Assistant Examiner*—Gregory J. Strimbu
*Attorney, Agent, or Firm*—Jacobson, Price, Holman & Stern, PLLC

[57] ABSTRACT

A jalousie window construction includes reinforced side jamb sections, full perimeter sealing for the window slats when the slats are closed and stackability of a plurality of the window constructions with the side jamb section reinforcement also functioning as reinforcement between adjacent stacked window constructions. The jalousie window construction further provides improved smooth and reduced friction pivoting of the plurality of slats thereof as well as reinforcement of the pivot shaft assemblies from which the slats are supported. The window construction also affords improved unobstructed viewing therethrough and includes a concealed mechanism for changing the angle of the pivotable slats.

30 Claims, 8 Drawing Sheets

REINFORCED JALOUSIE WINDOW WITH SPACED WALL SIDE JAMBS FOR PIVOT SUPPORT

CROSS-REFERENCE TO RELATED APPLICATIONS

Not applicable

STATEMENT REGARDING FEDERAL SPONSORED RESEARCH OR DEVELOPMENT

Not applicable

BACKGROUND OF THE INVENTION

1. Field of the Invention

This invention relates to an aluminum frame glass jalousie or security window. More specifically, this invention relates to a glass aluminum security window having numerous improvement features in structure, sealing capability, ease of operation and improved overall appearance.

2. Description of Related Art

Numerous prior U.S. patents disclose jalousie window constructions including some of the general overall structural components of the jalousie or security window of the instant invention. Cerny U.S. Pat. No. 2,228,439 discloses a frame enclosed jalousie window operating mechanism as well as various different seal strips. Fink U.S. Pat. No. 3,116,057 discloses a window operating mechanism within the window frame opening and including peripheral seals on each pivotal sash. Pappas U.S. Pat. No. 3,159,909 discloses peripheral seals on each pivoted window frame or sash. Beards U.S. Pat. No. 3,205,541 discloses seals between jalousie window slat ends and the adjacent jamb members. And, Dufrene U.S. Pat. No. 3,350,814 discloses a jalousie window operating mechanism concealed within outwardly opening jamb channels.

Further, Kahn et al. U.S. Pat. No. 3,484,990 discloses adjacent slat longitudinal edges provided with overlapping seals. Grahm U.S. Pat. No. 4,038,781 discloses slat panel end edge seals. Magill et al. U.S. Pat. No. 4,256,143 discloses frame jamb seals for cooperation with slat end edges, but with the slat end edges slidingly contacting the jamb seals inducing excessive wear. Jordal U.S. Pat. No. 4,813,183 discloses a frame head seal and slat longitudinal edge seals as well as jamb seals and an operating mechanism concealed within an outwardly opening jamb channel. Man U.S. Pat. No. 4,889,040 discloses jalousie slat longitudinal edge seals, and Vaida U.S. Pat. No. 5,267,414 discloses jamb seals as well as slat longitudinal edge seals.

Finally, there is a prior art jalousie window construction on the market over which the present invention represents a substantial improvement. This prior window construction is described hereinafter in connection with FIGS. 9, 10 and 11 of this application.

However, none of the prior art jalousie or security window constructions have the specific improvement features of the present invention, including (1) improved air sealing at the slat ends, (2) improved sealing between the uppermost slat and the header of the frame, (3) improved sealing at the pivot location for each of the slat support shaft assemblies, (4) increased frame structural strength, (5) less friction for the slat support shaft journal assemblies, (6) concealed slat operating mechanism and (7) upper header and lower sill members which allow interlocked stacking of two or more multiple glass slat jalousie windows.

SUMMARY OF THE INSTANT INVENTION

The security window of the instant invention incorporates a reinforced frame construction which not only reinforces each frame in which a plurality of slats are mounted, but which may also serve as reinforcement between vertically stacked multiple slat window construction frames. In addition, the security window also affords more complete air sealing along all four edges of the pivotal slat construction of the window and further is constructed in a manner such that the more complete air sealing may be readily accomplished upon pivotal movement of the window slats to the closed position.

The security window further incorporates a smoother, reduced friction pivot construction for each of the slat assemblies and also provides a pivotal mounting for each slat assembly which is of increased strength against unwanted entry.

Finally, the security window of this invention encloses the multiple slat actuating mechanism thereof within one of the outwardly opening vertical channel member jambs of the window. As so constructed, the actuating mechanism is concealed from view thus improving the overall appearance of the window.

In accordance with the foregoing, an object of this invention is to provide a jalousie window construction incorporating a frame of increased structural strength and which is specifically designed to enable vertical stacking of a plurality of the window constructions without sacrificing the increased structural strength feature thereof and in a manner which can securely lock the plurality of stacked window constructions together as a single unit.

Another object of this invention is to provide a jalousie window construction with more complete air sealing between adjacent slat assemblies and with the vertical jamb and the horizontal header sections of the window construction frame.

Still another object of this invention is to provide more complete air sealing in accordance with the preceding object and in a manner enabling such more complete air sealing to be more readily accomplished.

Yet another object of this invention is to provide a jalousie window construction with smoother and reduced friction pivot connections between the slat ends and the jalousie window frame jambs.

Still yet another object of this invention is to provide mounting and pivot shafts for the slats of the jalousie window construction which offer greater structural strength and thus increase resistance to unwanted entry therepast.

A final object of this invention to be specifically set forth herein is to provide a jalousie window construction in accordance with the preceding objects and which will conform to conventional forms of manufacture, be of simple construction and easy to install and use so as to provide a device that will be economically feasible, long lasting and relatively trouble free in use and operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENT

Figure 1:
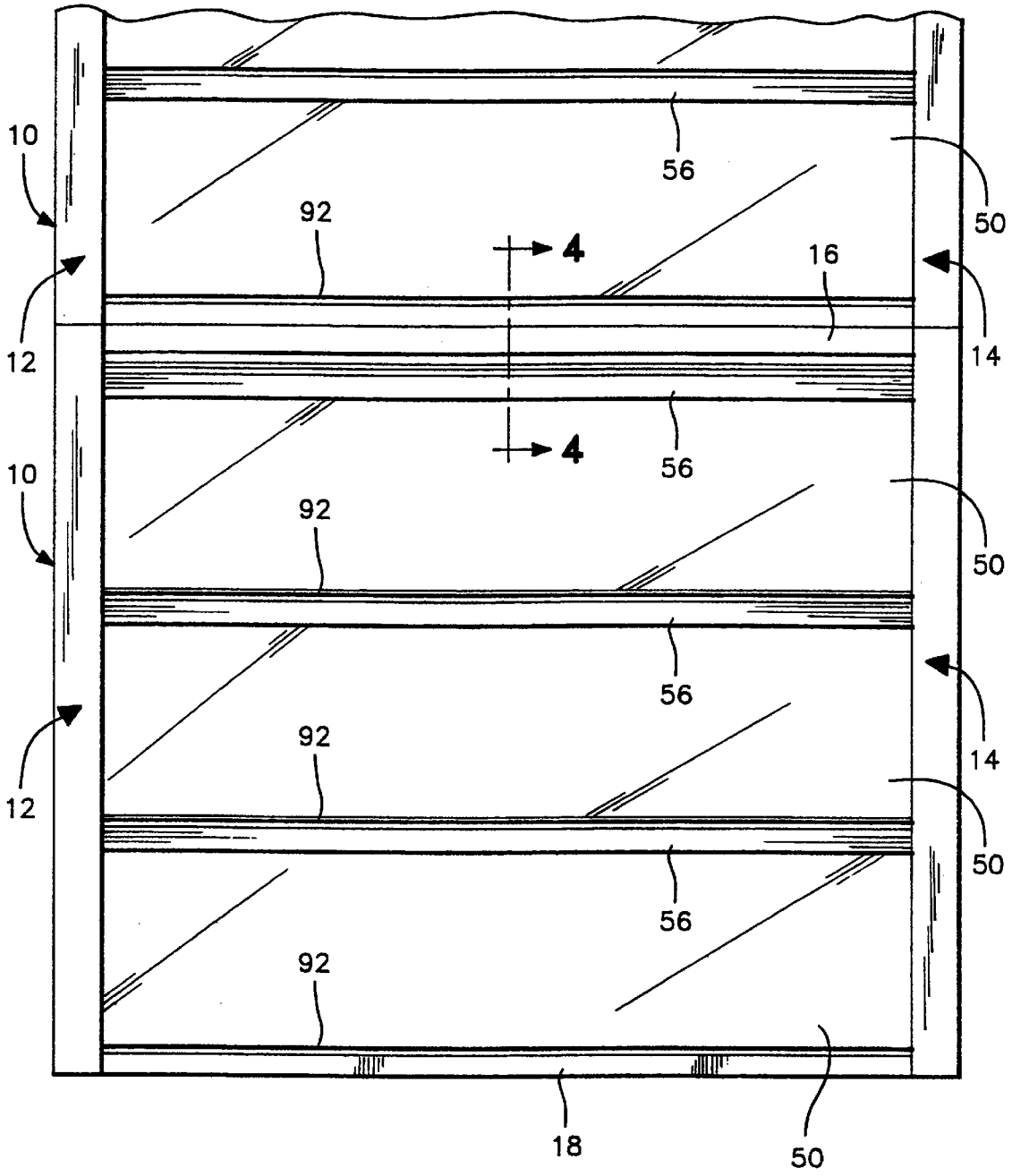
FIG. 1 is an outside elevational view of a pair of stacked security windows constructed in accordance with the present invention, the upper portion of the upper window being broken away.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

Referring now more specifically to FIG. 1 of the drawings, the numeral 10 generally designates a security window construction of the instant invention. The security window construction 10 includes a pair of top-to-bottom mirror image vertical side jamb sections 12 and 14 interconnected at their upper ends by a header section 16 and at their lower end by a sill section 18. Each jamb section 12 and 14 includes a pair of laterally spaced front and rear outwardly directed flanges 17 and 19, see FIGS. 6 and 7, interconnected at their inner ends by sides 20. Each inner jamb channel 12 and 14 also includes an outwardly facing counter channel 22 which is defined by front and rear side flanges 23 interconnected by a bight portion 25. The side flanges 23 include and inwardly projecting longitudinal tongues 24 extending along the full length of the side flanges 23.

Figure 5:
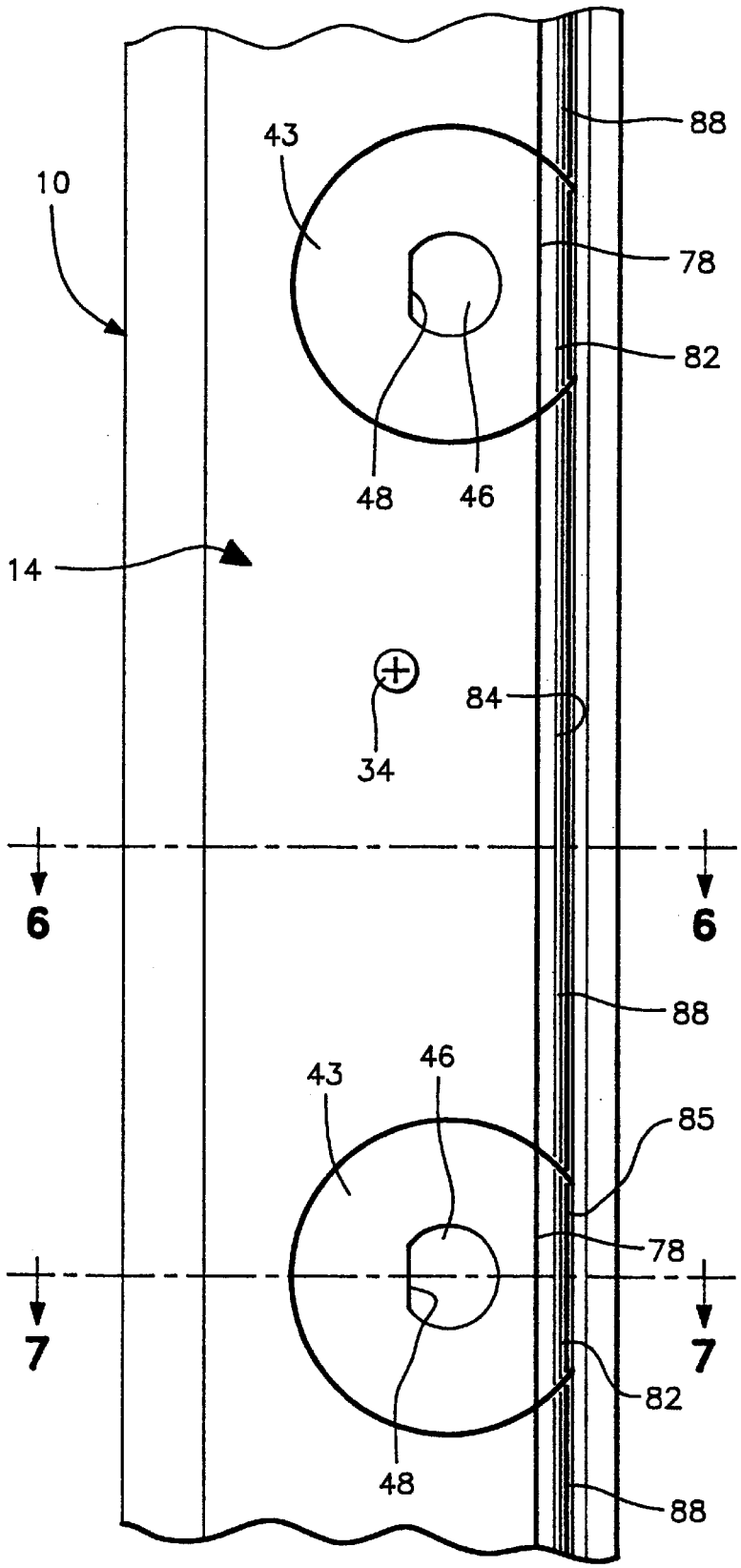
FIG. 5 is a fragmentary enlarged inside elevational view of the left jamb (looking out) of the window construction of the present invention illustrating two of the shaft disk bearings in position but with the other components of the slat support shaft assembly and glass slats omitted.

In addition, each jamb section 12 and 14 receives a top-to-bottom outer inwardly opening channel 26 having a bight portion 28 and opposite side flanges 30 defining outwardly opening longitudinal grooves 32. The outer channels 26 are slid longitudinally into the counter channels 22 of jamb section 12 and 14 with the tongues 24 snugly received within the grooves 32. Longitudinally spaced fasteners 34, see FIG. 5, are secured through the bight portions 25 and 28 to lock the channels 22 and 26 together against relative longitudinal movement. The utilization of the outer channels 26 interlockingly engaged with the counter channels 22 greatly increases the structural strength of the jamb sections 12 and 14.

Figure 4:
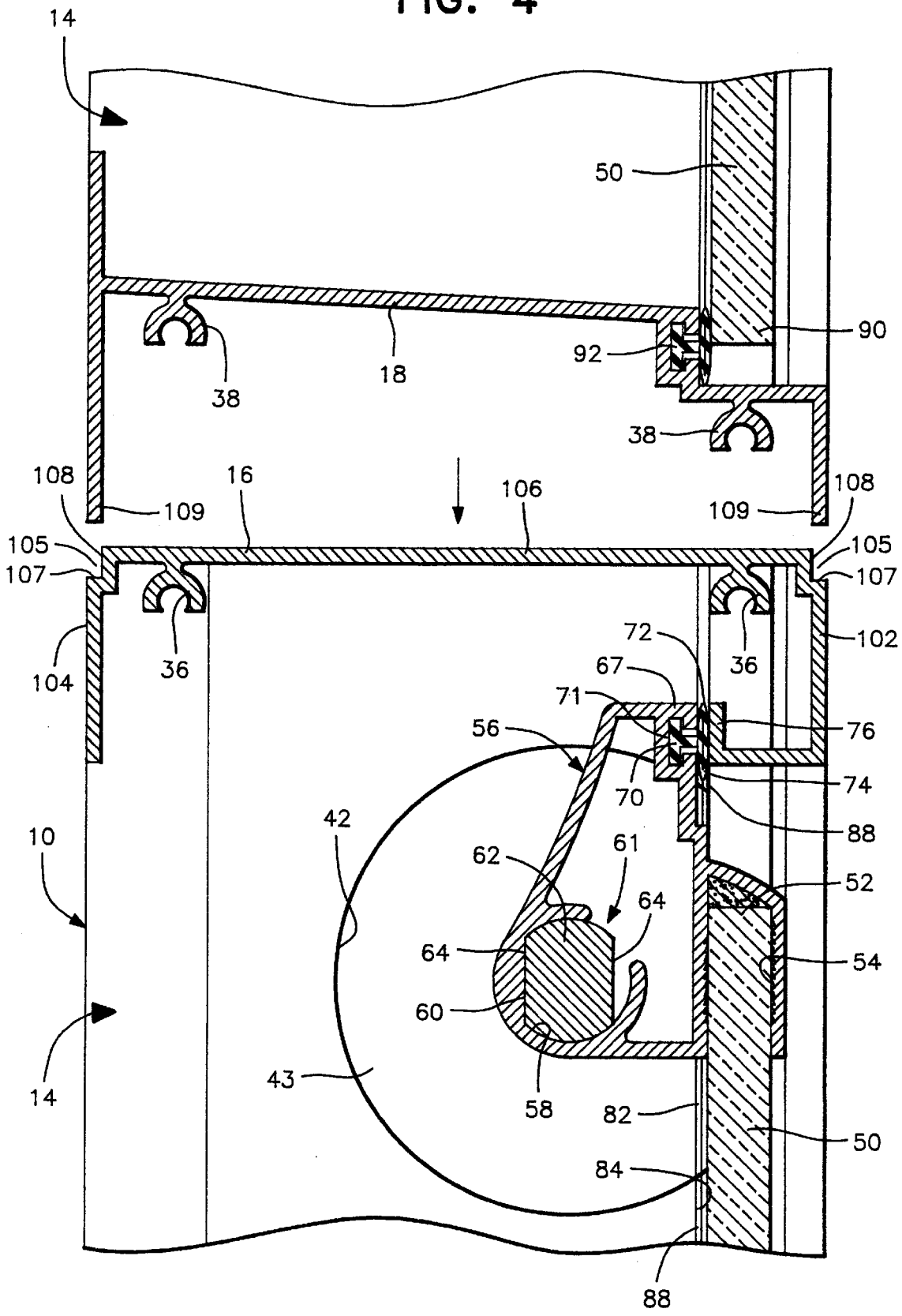
FIG. 4 is an enlarged fragmentary vertical sectional view taken upon the plane indicated by the section line 4—4 of FIG. 1 and with the lower sill and upper header of the upper and lower stacked window constructions in slightly exploded position.

The header and sill sections 16 and 18 include full length partial cylindrical extrusion sections 36 and 38, see FIG. 4. Threaded fasteners (not shown) are secured through the upper and lower ends of the jamb sections 12 and 14 and threaded into the extrusion sections 36 and 38 in order to securely fasten the header and sill sections 16 and 18 between the upper and lower ends of the jamb sections 12 and 14.

Figure 7:
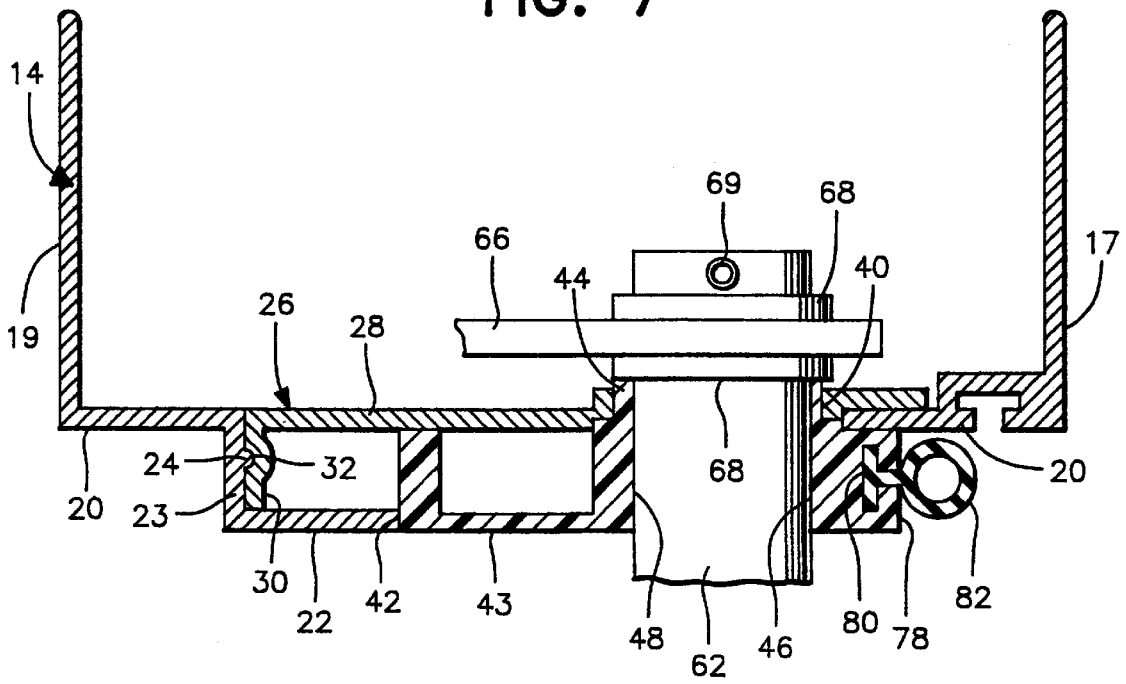
FIG. 7 is an enlarged horizontal sectional view taken substantially upon the plane indicated by the section line 7—7 of FIG. 5 with the shaft assembly included.

The outer channels 26 include longitudinally spaced openings 40 or bores formed therethrough aligned with longitudinally spaced openings 42 or bored formed in counter channels 22, see FIG. 7. A bearing disk 43 is journalled through each pair of aligned openings 40 and 42. The bearing disks 43 are made of plastic, nylon or other material suitably rotatable in the aluminum of jamb sections 12, 14 and 26 or other material of which they are made. Each disk 43 includes a central bore 46 having a flat cord side 48 and a diametrically reduced and axially shouldered outer end 44 which is properly journalled in opening 40 of outer channel 26. The axial shoulder of outer end 44 thus faces the opposed surface of the bight portion 28 of the outer channel 26 and rotates thereagainst with movement of the disk 43.

Each window construction 10, as illustrated, includes three glass slats 50, although any reasonable number can be included in the frame construction of the present invention. As shown in FIG. 4, each glass slat includes one longitudinal edge 52 received and secured in a laterally opening channel 54 of an extruded support bar, generally designated by the numeral 56. Support bar 56 also includes a lengthwise bore 58 extending longitudinally therethrough including a flattened side 60 and opening slot 61. A shaft 62 including diametrically opposite flats 64 is slidingly received through the bore 58 with one of the flats 64 engaged with the flat side 60 of the bore 58. The opposite ends of the shaft 62 are received through a pair of corresponding bearing disks 43 with one of the flats 64 mating with flat sides 48 of the central bores 46 thus locking the disks 43 for rotation with the shaft 62. The extreme ends of the shafts 62 have operating levers 66 mounted thereon. the operating levers 66 have openings formed therethrough of the same cross-sectional shape as the shaft 62 for rotation therewith between washers 68 and keeper pins 69. The keeper pins 69 are passed through diametric bores formed in the terminal ends of the shaft 62 for retaining the operating levers 66 on the shaft ends.

Figure 8:
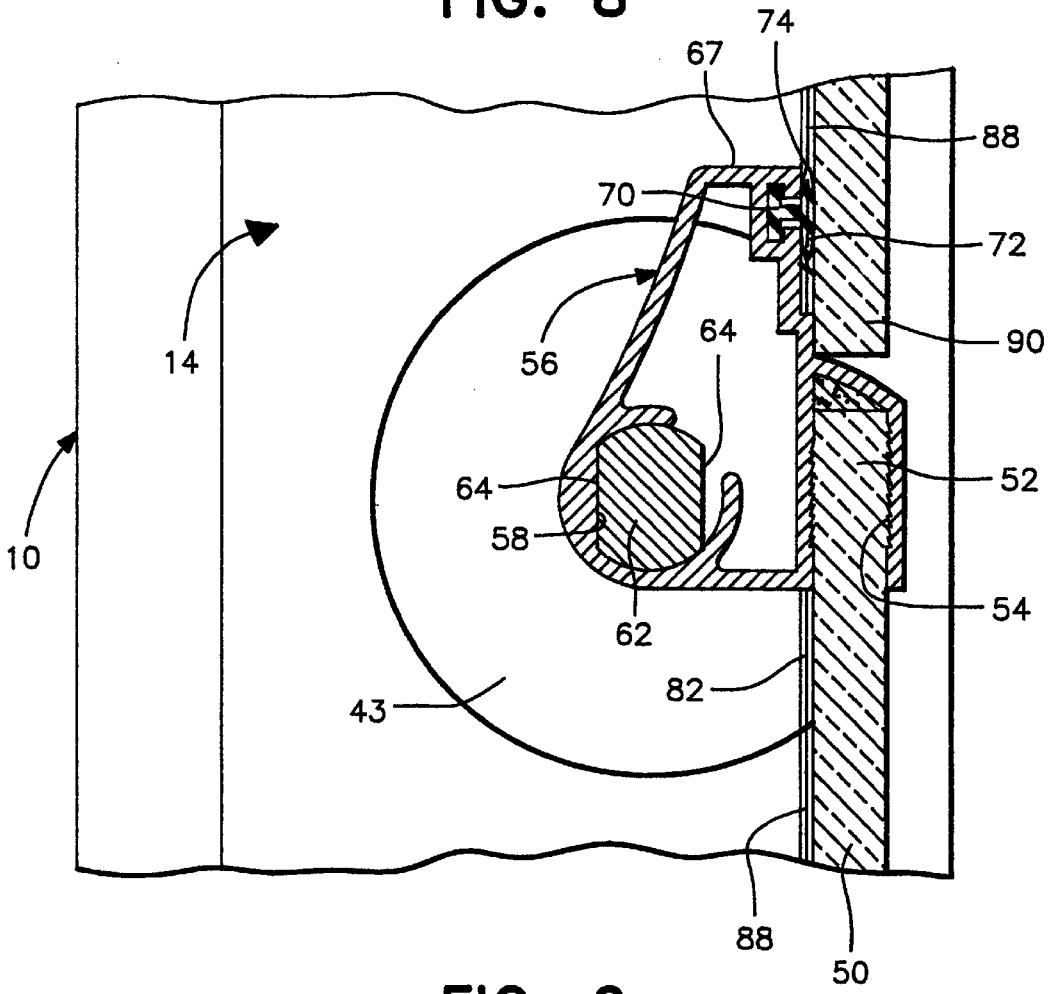
FIG. 8 is an enlarged fragmentary vertical sectional view of the glass slat supporting pivot assembly and adjacent glass slats.

The support bars 56 each also includes a laterally projecting and longitudinally extending arm 67 that has a longitudinal groove 71 in which an outwardly facing seal strip 70 is longitudinally slidably received. The seal strip 70 includes an outer cylindrical seal portion 72 which is flattened in the manner illustrated at 74 in FIG. 8 when the glass slats 50 are rotated to their coplanar closed position. In this position, seal portion 72 of strips on the middle and lowermost support bars 56 seal against the lower or free swinging marginal edges 90 of the middle and uppermost glass slats 50, see FIGS. 2 and 8. At the same time, when the uppermost support bar 56 is rotated to the closed position, arm 67 thereon pivots forwardly into close proximity with an abutment flange 76 formed in the header section 16. The engagement of seal portion 72 of seal strip 70 with abutment flange 76 forms an airtight seal between the arm 67 and the header section 16 when the upper glass slat 50 is swung to the closed position, as illustrated in FIG. 4.

Figure 6:
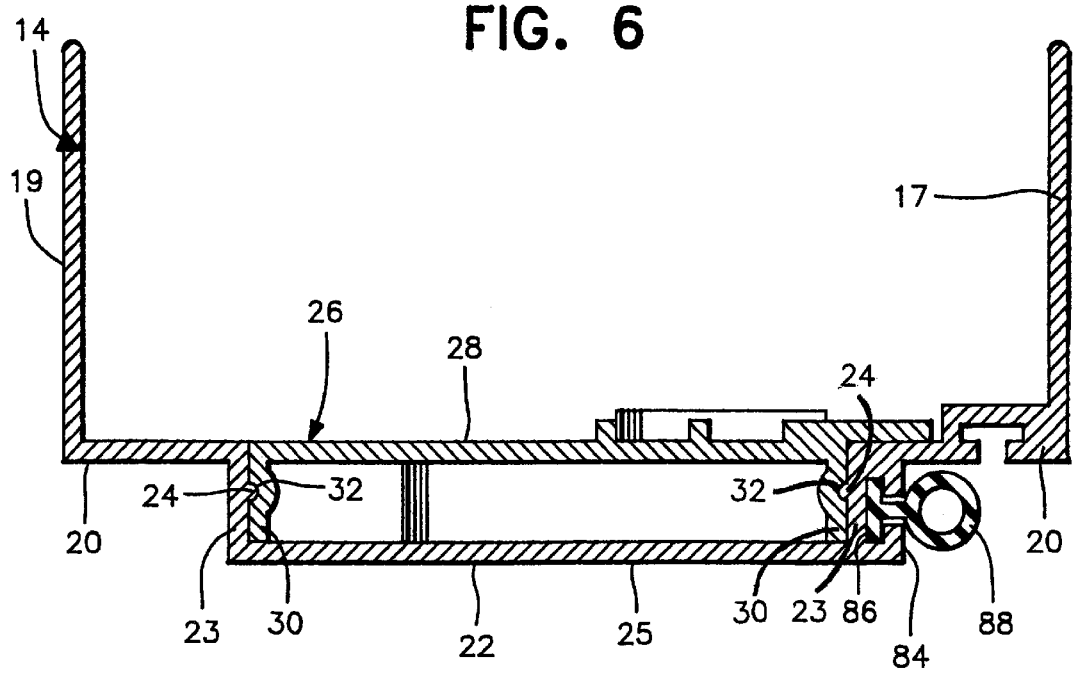
FIG. 6 is an enlarged horizontal sectional view taken substantially upon the plane indicated by the section line 6—6 of FIG. 5.

Each jamb section 12 and 14 includes a seal strip groove 86 extending longitudinally thereof opening through the abutment surface 84 of front side flange 23, see FIG. 6. The abutment surface 84 of the jamb channel pair 12, 14 thus forms vertical coplanar seal strip supporting flanges against which the ends of slats 50 align when closed. Further, as shown in FIG. 5, the vertical surfaces 84 are interrupted as at 85 to allow bearing disks 43 to rotate when the slats 50 are opened. A seal strip 88 preferably having the same configuration as seal strip 70 is disposed in groove 86. When the glass slats 50 are in their closed position, the seal strips 88 serve to seal the major extent of each end of the slats 50. In addition, each bearing disk 43 includes a flattened side 78 having a seal strip groove 80 formed therein for receiving a seal strip 82 which is always in sealing engagement with slat 50 and corresponds to the seal strips 88 in each front side flange 23. The flat side 78 of each bearing disk 43 forms a cord surface which is coextensive with the abutment surface 84 of the front side flange 23 of counter channel 12 or 22 when the corresponding glass slat 50 is in the closed position. Thus, seal strips 82 and 88 are coextensive and form a continuous seal downwardly along each side jamb section 12 and 14 which the slats 50 are closed for sealing with the end edges of the glass slats 50.

As shown in FIG. 4, it will be noted that the channels 54 are spaced laterally an appreciable distance from the center of the shaft 62, with the spacing between the center of the shaft 62 and the near side of the channel 54 being slightly more than twice the width of the channel 54. In addition, the effective length of the arm 67 is such that the seal strip 70 is approximately four times the width of the channel 54 from the center of shaft 62. Also, it is to be noted that the center axis of the shaft 62 is generally half way between planes containing the closed end of the channel 54 and the open end of the channel 54 from which the glass slat 50 projects. All of this ensures that the seal strips 72, 82 and 88 are also substantially fully compressed or flattened as at 74 in FIG. 4 when the glass slats 50 are in the coplanar closed positions. Further, as may be seen from the upper portion of FIG. 4, a seal strip 92 corresponding to the seal strips 70 seals against the lower longitudinal edge 90 of the lower glass slat 50 when the glass slats 50 are in the closed positions.

From the foregoing, it will be seen that the free margins of the arms 67 are sealed relative to the abutment flange 76 and the lower margins 90 of each of the glass slats 50 spaced above the lowest glass slat 50 and that the seal strip 92 forms a seal with the lower margin 90 of the lowermost glass slat 50, when the slats 50 are rotated to the closed position. In addition, as may be seen to best advantage in FIG. 5, the seals 82 and 88 are provided to seal against the end edges of the glass slats 50 when in their closed position. Thus, when the glass slats 50 are in their closed position, the outside perimeter of the slats 50 is effectively sealed on all sides, and thus the window construction 10 is substantially fully sealed against the passage of air into the inside of or through the window construction.

Figure 2:
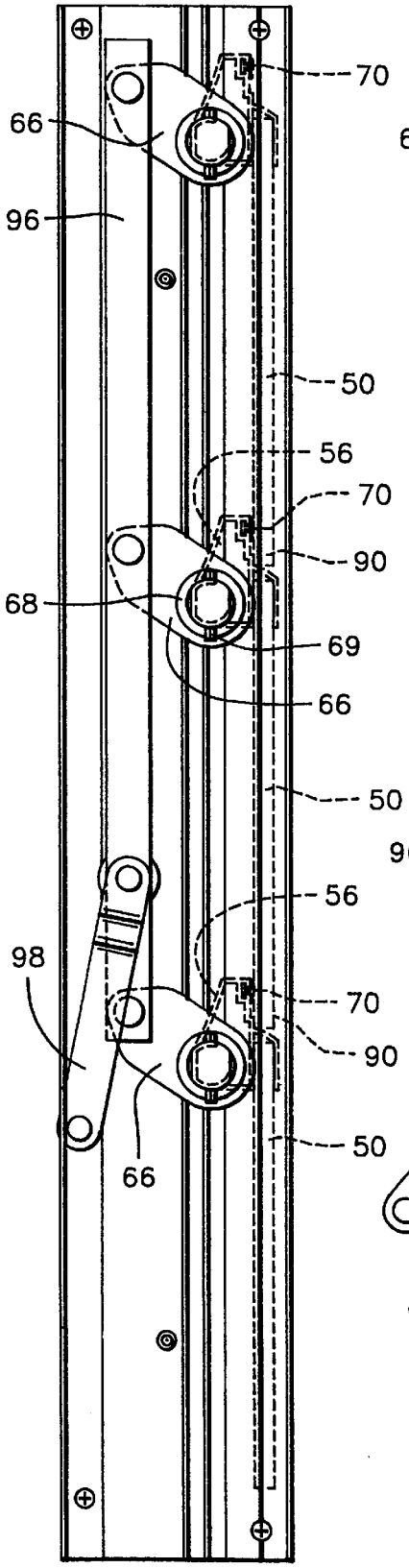
FIG. 2 is a right side elevational view of the window construction of the present invention illustrating the slat actuating mechanism with the slats in a coplanar closed position.
Figure 3:
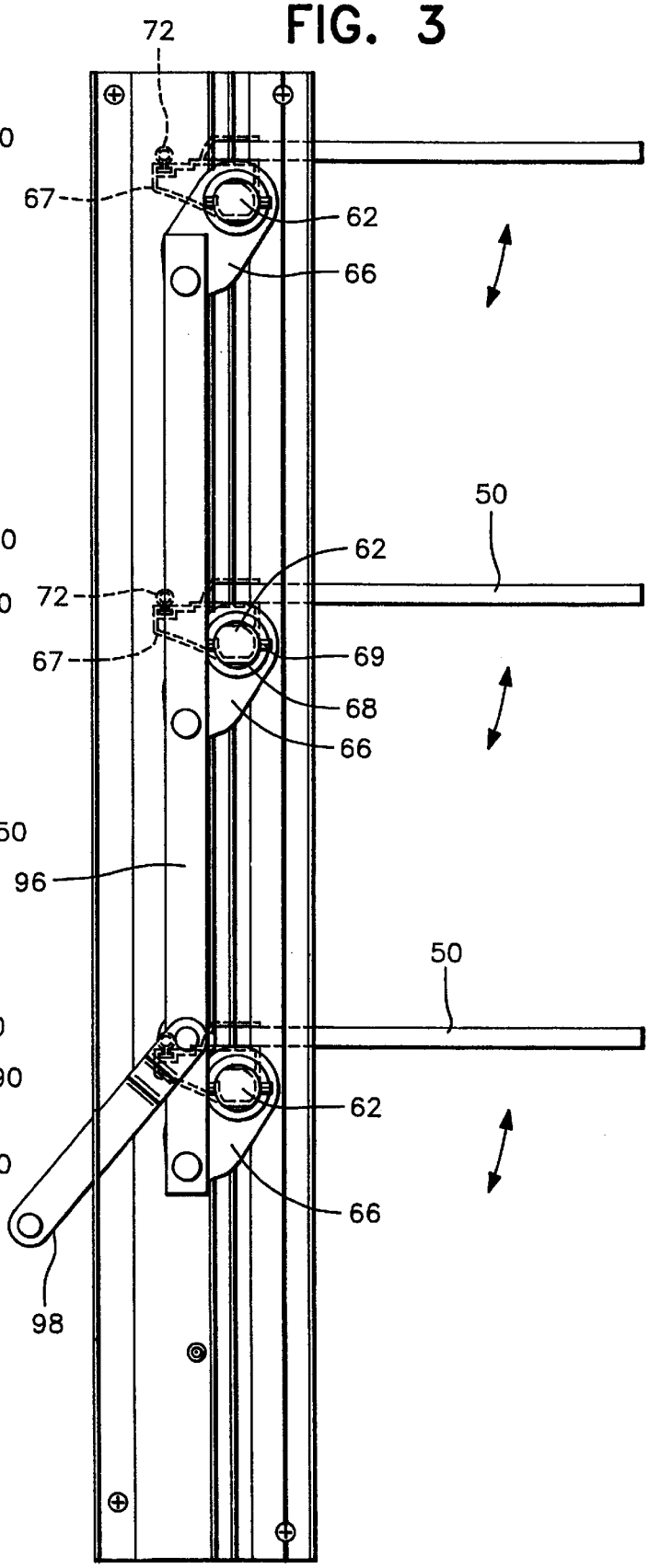
FIG. 3 is a right side elevational view similar to FIG. 2 but illustrating the slat operating mechanism in position with the slats in a vertically spaced, parallel open position.

From FIGS. 2 and 3 it may be seen that each set of levers 66 includes free ends pivotally connected to an operating bar 96 and that each operating bar 96 has one end of an actuating lever 98 pivotally connected thereto for acting upon by any suitable form of slat operating mechanism (not shown).

With attention now invited more specifically to FIG. 7, it will be noted that minimal clearance between the shaft 62 and the center bore 46 provides an extremely stable connection between the bearing disk 43 and the shaft 62 due to the long axial extent of the connection between the disk 43 and shaft 62. Furthermore, the bearing disk 43, at axially spaced locations, is journalled through the openings 40 and 42 to provide even more stable support for the shaft 62 and this greater support is provided in a manner leading to a smoother operation and minimal friction as the shaft 62 is rotated with bearing disks 43 in jamb channels 12 and 14. Also, because the extrusion comprising the support bar 56 is of appreciable thickness in two directions angularly displaced approximately 90° relative to each other (horizontal and vertical as shown in FIG. 4), the overall strength of the support bar 56 against lateral deflection is greatly increased. Thus, with relatively closely spaced support bars 56 that strongly resist lateral deflection, and the inclusion of reinforced jamb section 12 and 14 between which the support bars 56 extend, a jalousie window construction offering greater strength and security against unwanted passage therethrough is provided.

Turning now back to FIGS. 1 and 4, it will be seen that two or more security window constructions 10 can be stacked in the manner illustrated in FIG. 1. As shown in FIG. 4, the upper corners of front and rear surfaces 102 and 104 of the header section 16 are joined to the upper surface 106 by notches 105 defined by front and rear pairs of right angulated upwardly and outwardly facing surfaces 107 and 108. Each pair of surfaces 107 and 108 defines a seat in which to receive the front and rear depending flanges 109 of the sill section of a window construction 10 to be disposed in stacked relation relative to a lower window construction 10. Further, although each of the stacked window constructions 10 includes a single pair of inner jamb sections 12 and 14, such stacked window constructions 10 may include a single outer channel 26 extending between and interconnecting each set of corresponding jamb sections 12 and 14. Thus, the inner channels 26 on each side of the stacked window construction 10 illustrated in FIG. 1 can extend the entire height of the window assembly and interconnect all of the stacked window constructions 10 thereof. Of course, each window construction 10 may include more or less than three glass slats 50 as previously stated.

In operation, starting with the glass slats 50 in the closed position, an operator (not shown), such as a crank handle journalled from one of the jamb sections 12, 14 and operably connected to the operating lever 98, is rotated resulting in a downward pull on the operating lever 98 from the position thereof illustrated in FIG. 2 to the position illustrated in FIG. 3.

As the operating lever 98 is pulled downward, the operating levers 66 are rotated counterclockwise from the position illustrated in FIG. 2 to the position illustrated in FIG. 3, thus rotating shafts 62, bearing disks 43 and support bars 56. As bars 56 are rotated in the counter-clockwise direction, the glass slats 50 are swung from the vertical position illustrated in phantom lines in FIG. 2 to the horizontal positions illustrated in solid lines in FIG. 3. At the same time, seal strips 70 are swung inwardly away from the abutment flange 76 and the plane containing the inner surfaces of the glass slats 50 when the latter are in the closed positions. Also, the end edges of the glass slats 50 swing outwardly from the seal strips 88 (the seal strips 82 remaining in contact with the glass slats 50 as they swing to the open positions).

When it is desired to close the glass slats 50, the aforementioned operator (not shown) is turned in the opposite direction to exert an upward force on the operating lever 98 causing the operating levers 66 to swing in a clockwise direction to move slats 50 from the parallel open position thereof illustrated in FIG. 3 to the coplanar closed position illustrated in FIG. 2. Shafts 62, bearing disks 43 and support bars 56 are similarly rotated in the clockwise direction. As the glass slats 50 approach the closed position, the ends of the glass slats 50 compress the seals 88 while the uppermost seal 70 approaches and compresses against the abutment flange 76, and the seals 70 below the uppermost seal 70 swing forward (outward) toward and flatten against the rearward swinging lower marginal edges of the glass slats 50 disposed above the lowermost glass slat 50. Upon rearward swinging of the lower margin 90 of the lowermost glass slat 50, the seal strip 92 is engaged and flattened. In this manner, a complete seal is formed about the exposed margin of each glass slat 50 when the glass slats are swung to the closed position. Thus, improved sealing against the movement of air through the security window construction 10 is afforded. In addition, due to the considerable lateral offset of the channels 54 from the centers of the associated shafts 62, the glass slats 50 may be swung to open positions which are substantially horizontal and allow maximum air flow therebetween.

Figure 9:
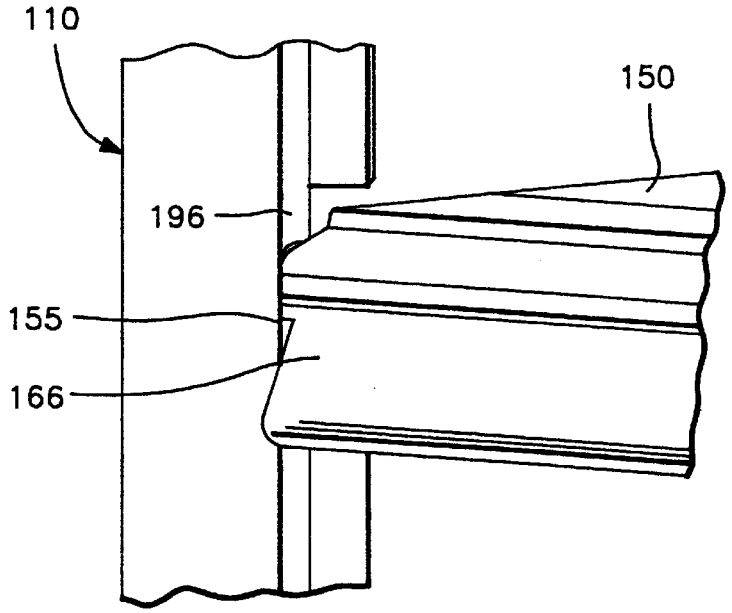
FIG. 9 (PRIOR ART)
FIG. 9 is a fragmentary perspective view of a prior art louver assembly purportedly being manufactured and similar to the structure disclosed in FIGS. 4–6 of Vaida U.S. Pat. No. 5,267,414.
Figure 10:
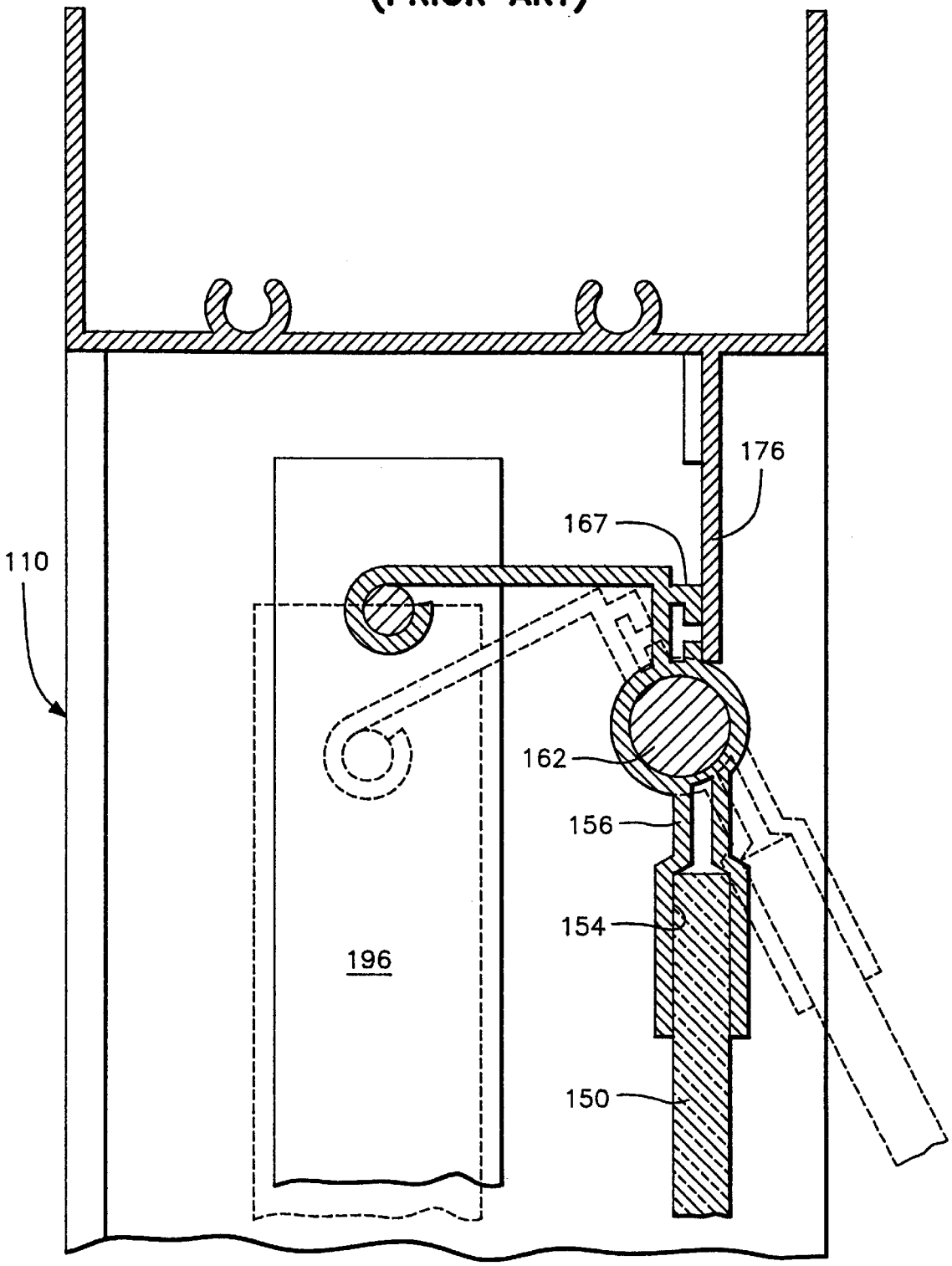
FIG. 10 (PRIOR ART)
FIG. 10 is an enlarged fragmentary vertical sectional view of the prior art structure illustrating the manner in which the uppermost slat supporting shaft structure is devoid of a flexible seal for closing against a depending flange of the upper header.
Figure 11:
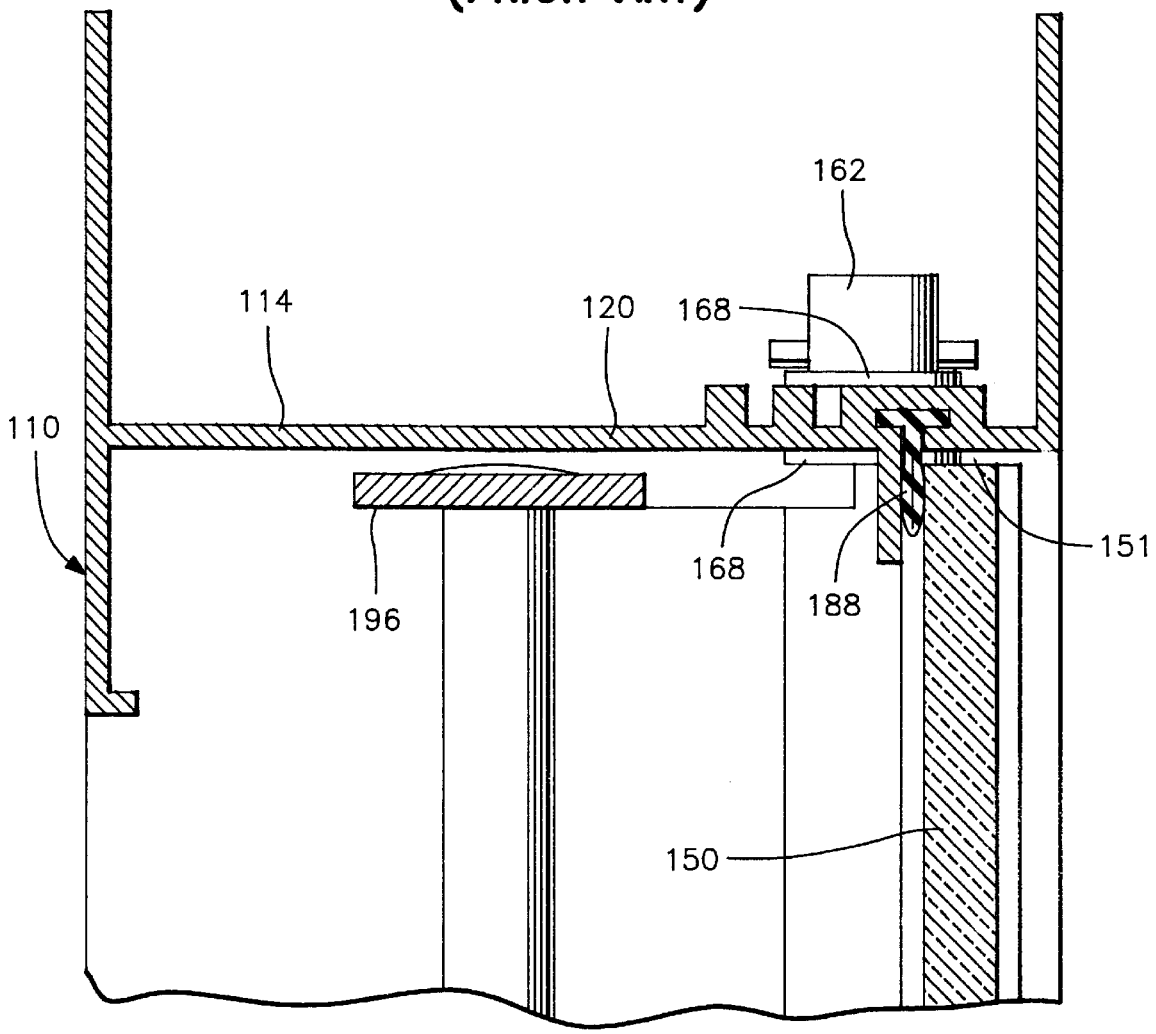
FIG. 11 (PRIOR ART)
FIG. 11 is an enlarged fragmentary horizontal sectional view illustrating the manner in which the slat end seals of the prior art structure project into the window opening from opposite sides thus impeding movement of the slats toward their fully closed position.

With attention now invited more specifically to FIGS. 9–11, a prior art window construction generally referred to by the reference numeral 110 is illustrated. Window construction 110 is currently being manufactured and sold by Industrias Metallicas Marva, purportedly under Vaida U.S. Pat. No. 5,267,414. In the window construction 110, the top of channel 154 corresponding to the channel 54 of the structure disclosed in FIGS. 1–8 is vertically spaced below shaft 162 corresponding to the shaft 62, when the glass slat 150 corresponding to the glass slat 50 is in the closed position, see FIG. 10. Further, although the abutment flange 176 corresponding to the abutment flange 76 is opposed by a slotted arm portion 167 corresponding to the arm 67, the arm portion 167 does not include a seal strip corresponding to the seal strip 70. Furthermore, the free end of the arm portion 167, the shaft 162 and the channel 154 are all generally aligned vertically when the glass slat 150 is in the closed position, thus increasing the overall height of the support bar 156 and narrowing the view through the window construction 110. In addition, as may be best seen from FIG. 11, the operating bar 196 corresponding to the operating bar 96 is disposed within the window opening, and the side seals 188 corresponding to the seals 88 extend laterally inwardly from the jamb sections 114. Still further, with attention invited more specifically to FIGS. 9 and 10, the glass slats 150 are only ever-so-slightly offset from the center axis of the shaft 162; thus, the contact as at 155 between the arm portion 166 and the connecting lever 196 limits swinging movement of the glass slats 150 to the open position thereof, in which open position the glass slats 150 are inclined approximately 25° below horizontal positions. This is in sharp contrast to the construction of the present invention in which the glass slats 50 can be opened to substantially the full horizontal position.

Also, inasmuch as the end portions of shaft 162, see FIG. 11, of the window construction 110 are journalled directly through the bight portions 120 of the jamb sections 114 and include inner and outer washers 168 corresponding to the washers 68, there is considerable opportunity for air leakage past the opposite end edges of the glass slats 150 as at 151 and through the jamb section openings in which the ends of shaft 162 are journalled.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A jalousie window construction which comprises a frame incorporating a pair of upstanding opposite side jamb sections each having upper and lower ends, a plurality of spaced support bars each supporting an elongated slat along a longitudinal edge of said slat, said support bars extending between and including opposite end portions journalled from said opposite side jamb sections and rotatable for angular movement of said slats between spaced, substantially parallel open positions extending outwardly from said frame and a coplanar closed position, horizontal header and lower sill frame sections extending between and interconnecting the upper and lower ends, respectively, of said jamb sections, each side jamb section including an inner outwardly opening metal channel and an outer metal member snugly received and secured in said inner channel to form two horizontally spaced vertical metal walls, each said opposite end portion of said support bars extending through both said spaced vertical walls when journalled from a respective one of said opposite side jamb sections, and an operating mechanism attached to one of said end portions of each support bar to rotate said support bars and to angularly move said slats between said open positions and said closed position.

2. The jalousie window construction of claim 1 wherein each said inner channel includes outwardly directed flanges and an outwardly facing counter channel, said counter channel and said outer member of each jamb section forming said spaced vertical walls.

3. The jalousie window construction of claim 2 wherein said opposite end portions each include an endwise outwardly projecting shaft end and a diametrically enlarged bearing disk mounted thereon for rotation therewith, said spaced walls of said jamb section having bores formed therein, and end portions of each disk being journalled in an aligned pair of said bores.

4. The jalousie window construction of claim 3 wherein each said bearing disk includes an inner end axial face substantially flush with a surface of a respective one of the counter channels adjacent the slats.

5. The jalousie window construction of claim 3 wherein said bearing disks are constructed of plastic.

6. The jalousie window construction of claim 3 wherein said bores have diameters and the diameter of one bore of each said pair of aligned bores is smaller than the diameter of the other bore of said pair of aligned bores and a corresponding one of said end portions of each said bearing disk is diametrically reduced to provide an axially facing shoulder to engage a respective one of said outer members.

7. The jalousie window construction of claim 1 wherein each said outer member includes an inwardly opening channel fitting in a respective one of said inner outwardly opening channels, each said inwardly opening channel and said inner outwardly opening channel having a bight portion which form said spaced vertical walls.

8. The jalousie window construction of claim 7, wherein said inner outwardly opening channel and inwardly opening channel include longitudinally extending telescopic flanges, said interfitted telescopic flanges including tongues and grooves for guided longitudinal shifting of said outer members and said inner outwardly opening relative to each other, and fasteners securing said outer and said inner outwardly opening channels together and against relative longitudinal shifting.

9. The jalousie window construction of claim 1, wherein said elongated slats are glass slats.

10. The jalousie window construction of claim 1, wherein said spaced vertical walls extend between said upper and lower ends of each said side jamb section.

11. The jalousie window construction of claim 1 wherein each said support bar has a laterally opening support channel which receives and supports said slat longitudinal edge therein, said opposite end portions of each said support bar defining an axis of rotation of each said support bar which is spaced horizontally with respect to said support channel when said slats are in the closed position.

12. The jalousie window construction of claim 11 including a horizontal seal strip mounted from and extending along each said support bar above said support channel for sealingly engaging one of a lower edge of the slats and said horizontal header frame section.

13. The jalousie window construction of claim 12 wherein an uppermost one of said support bar seal strips abuts and seals against an opposing seal surface of said header frame section when said slats are in the closed position.

14. A jalousie window construction which comprises a frame incorporating a pair of upstanding opposite side jamb sections each having upper and lower ends, a plurality of vertically spaced slats extending between and including opposite end portions journalled from said side jamb sections for angular movement between spaced open positions and a coplanar closed position, horizontal header and lower sill frame sections extending between and interconnecting the upper and lower ends, respectively, of said jamb sections, each side jamb section including a pair of spaced interconnected inner and outer members, said slat end portions including endwise outwardly projecting shaft ends, a diametrically enlarged bearing disk mounted on each shaft end for rotation therewith, said inner and outer members having pairs of aligned bores formed therein, axially spaced end portions of each disk being journalled in a corresponding one of said pairs of aligned bores, said jamb sections including coplanar seal strip supporting flanges, each of said seal strip supporting flanges having a seal strip supported therefrom and said flanges being interrupted adjacent each pair of said pairs of aligned bores, said bearing disks each including a cord surface which, when said slats are in the closed position, is substantially coextensive with a corresponding one of said seal strip supporting flanges and has its own seal strip.

15. The jalousie window construction of claim 14, wherein said slats each include a horizontal seal strip mounted adjacent an upper edge thereof above an axis of rotation of said slats journalled in said side jamb sections and adopted to sealingly engage a lower edge of one of said slats disposed thereabove.

16. A jalousie window construction comprising a concealed operating mechanism, opposite side jamb sections, a plurality of slats disposed between said jamb sections for angular movement between spaced parallel open positions and a coplanar closed position and each including a base longitudinal edge and a free swinging longitudinal edge, a pivot shaft assembly for each slat from which the base longitudinal edge only of the slat is supported, said pivot shaft assemblies each including shaft ends extending through bearing disks which are supported for rotation therewith, said opposite side jamb sections each having an inside surface, said opposite side jamb sections supporting the bearing disks therefrom, and said operating mechanism being adapted to move said slats in unison, being attached to one of said shaft ends of each pivot shaft assembly and extending beyond a corresponding one of said bearing disks on a side of a corresponding one of said side jamb sections opposite said slats so that said operating mechanism is concealed when said window construction is installed, said bearing disks having an inside surface and supported in said opposite side jamb sections so that said bearing disk inside surfaces are substantially co-planar with the inside surfaces of the side jamb sections from which the bearing disks are supported.

17. The jalousie window construction of claim 16, wherein said side jamb sections include opposite outwardly opening channels and said operating mechanism is disposed within the channel of the corresponding one of said side jamb sections.

18. The jalousie window construction of claim 17, wherein said operating mechanism includes operating levers affixed to said one of said shaft ends of each of the pivot shaft assemblies and an operating bar connected to said operating levers whereby movement of the operating bar rotates said operating levers an equal distance to move said pivot shaft assemblies and said slats in unison, said operating levers and said operating bar being positioned within said channel of the corresponding one of said side jamb sections.

19. The jalousie window construction of claim 17 wherein said side jamb sections are metal and said bearing disks are constructed of plastic.

20. The jalousie window construction of claim 19, wherein said slats are glass.

21. The jalousie window construction of claim 16, wherein said pivot shaft assemblies each include a solid metal shaft having said shaft ends, said bearing disks having a portion with a diameter substantially greater than the diameter of said solid metal shaft so as to better stabilize rotational movement of said pivot shaft assemblies in said opposite side jamb sections.

22. A security window including a pair of upstanding opposite metal side jamb sections each having upper and lower ends, metal horizontal header and lower sill frame sections extending between and interconnecting the upper and lower ends, respectively, of said jamb sections, a plurality of vertically spaced metal pivot shaft assemblies each supporting an elongated slat along a longitudinal edge of said slat, said pivot shaft assemblies extending between and including opposite end portions journalled from said opposite side jamb sections, said pivot shaft assemblies operatively connected for simultaneous angular movement of said slats between spaced, substantially horizontal open positions extending outwardly from said side jamb sections and a coplanar closed position, each side jamb section including a pair of interconnected inner and outer channels, each said inner channel opening outwardly and defining an outwardly opening counter channel therein and each said outer channel opening inwardly and snugly received in a respective one of said counter channels, said end portions of said pivot shaft assemblies extending through said counter channels and said outer channels when journalled from said opposite side jamb sections.

23. The security window of claim 22, wherein the inner and outer channels of each said side jamb section are longitudinally slidingly interlockingly engaged with each other and fastened together against relative longitudinal movement.

24. The security window of claim 22, and further including vertically and horizontally extending seal strips which seal each slat substantially around its entire parameter when said slats are in the closed position.

25. The security window of claim 24, wherein said slats are glass.

26. A jalousie window construction which comprises a frame incorporating a pair of upstanding opposite side jamb sections each having upper and lower ends, a plurality of vertically spaced slats disposed between said jamb sections for angular displacement between spaced, substantially horizontal open positions and a coplanar closed position, horizontal upper header and lower sill frame sections respectively, extending between and interconnecting the upper and lower ends of said jamb sections respectively, said slats each including a base longitudinal edge and a free swinging longitudinal edge, a pivot shaft assembly for each slat including an elongated channel in which a corresponding one of said slat base longitudinal edges is secured, said pivot shaft assemblies each including shaft ends journalled from the side jamb sections for rotation of said pivot shaft assemblies about substantially horizontal axes, said pivot shaft assemblies each comprising a generally tubular support bar having a vertical cross-section in the general shape of a quadrangle having at least two corner right angles to provide rigidity to said pivot shaft assemblies and to said window construction and a solid metal shaft extending horizontally therethrough a side of the support bar opposite the side of the support bar defined by the two corner right angles.

27. The jalousie window construction of claim 26, wherein each said elongated channel is adjacent one side of a respective one of said quadrangles.

28. The jalousie window construction of claim 27, wherein said one side of said respective one of said quadrangles forms one side of said elongated channel.

29. The jalousie window construction of claim 26 wherein each said side jamb section includes an inner outwardly opening channel and an outer member secured in said inner outwardly opening channel to form spaced interconnected inner and outer vertical walls, said shaft ends journalled from both said vertical walls of said jamb sections.

30. The jalousie window construction of claim 26, wherein, said solid metal shafts comprising said shaft ends and provide additional rigidity to said pivot shaft assemblies.

* * * * *